US009421595B2

(12) United States Patent
Sandrin et al.

(10) Patent No.: US 9,421,595 B2
(45) Date of Patent: Aug. 23, 2016

(54) INTEGRATED BENDING AND SHIFTING SYSTEM UNDER LOAD FOR LARGE OPENING STANDS BETWEEN THE WORKING ROLLS

(75) Inventors: Luca Sandrin, Terzo di Aquileia (IT); Karl Heinz Wessel, Dinslaken (DE); Andrea Dorigo, Manzano (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 336 days.

(21) Appl. No.: 13/814,212

(22) PCT Filed: Aug. 5, 2011

(86) PCT No.: PCT/EP2011/063520

§ 371 (c)(1),
(2), (4) Date: Feb. 4, 2013

(87) PCT Pub. No.: WO2012/017072

PCT Pub. Date: Feb. 9, 2012

(65) Prior Publication Data

US 2013/0125602 A1 May 23, 2013

(30) Foreign Application Priority Data

Aug. 5, 2010 (IT) ..... MI2010A1502

(51) Int. Cl.
*B21D 5/00* (2006.01)
*B21B 29/00* (2006.01)
(Continued)

(52) U.S. Cl.
CPC . *B21D 5/00* (2013.01); *B21B 29/00* (2013.01); *B21B 31/18* (2013.01); *B21B 31/20* (2013.01); *B21B 37/42* (2013.01)

(58) Field of Classification Search
CPC ..... B21B 37/18; B21B 31/02; B21B 29/00; B21B 2031/023; B21B 2031/025; B21B 2031/026; B21B 31/18; B21B 31/20; B21B 37/42; B21D 5/00
USPC ..... 72/211, 241.4, 241.6, 241.8, 241.2, 72/242.2, 242.4, 243.2, 243.4, 243.6
See application file for complete search history.

(56) References Cited

U.S. PATENT DOCUMENTS 4,770,021 A 9/1988 Kobayashi et al.
5,090,228 A * 2/1992 Schmiedberg et al. ..... 72/238
(Continued)

FOREIGN PATENT DOCUMENTS

DE 3811875 4/1989
WO WO2005011885 2/2005

OTHER PUBLICATIONS

International Search Report and Written Opinion for International Application No. PCT/EP2011/063520; 9 pages.

*Primary Examiner* — Shelley Self
*Assistant Examiner* — Gregory Swiatocha
(74) *Attorney, Agent, or Firm* — Stetina Brunda Garred & Brucker

(57) ABSTRACT

A rolling stand with a bending and shifting device for rolling rolls with two lower blocks fixed to the housing and carrying a lower chock, two upper blocks connected to an upper chock, a shifting device for the upper roll connected to the upper chock via a sliding coupling, a shifting device for the lower working roll connected to the lower chock via a sliding coupling. The lower chock is coupled to the blocks via a sliding coupling which allows the chock to be moved in a vertical direction to generate a bending of the lower roll via actuators. The two upper blocks are vertically coupled with the housing to allow the upper roll to be bent. The shifting movement of the upper roll is achieved via a sliding coupling between the upper chock and the two upper blocks, and may be carried out under load when rolling operations occur.

10 Claims, 3 Drawing Sheets

(51) Int. Cl.

| | |
|---|---|
| ***B21B 31/18*** | (2006.01) |
| ***B21B 31/20*** | (2006.01) |
| ***B21B 37/42*** | (2006.01) |

(56) References Cited

U.S. PATENT DOCUMENTS

| | | | | |
|---|---|---|---|---|
| 5,752,404 | A | 5/1998 | White et al. | |
| 6,029,491 | A | 2/2000 | Ginzburg | |
| 6,112,569 | A | 9/2000 | Ossendorf | |
| 6,993,951 | B1 * | 2/2006 | Sudau et al. | 72/241.8 |
| 7,310,985 | B2 * | 12/2007 | Thiel | B21B 29/00 72/237 |
| 2007/0129228 | A1 * | 6/2007 | Zieser et al. | 492/15 |
| 2011/0132055 | A1 * | 6/2011 | Diehl et al. | 72/245 |

* cited by examiner

INTEGRATED BENDING AND SHIFTING SYSTEM UNDER LOAD FOR LARGE OPENING STANDS BETWEEN THE WORKING ROLLS

FIELD OF THE INVENTION

The present invention relates to a combined system which allows the working rolls under load to be shifted while the bending load is simultaneously applied to the chocks of the working rolls also if a large opening is to be ensured between the working rolls in a rolling stand.

STATE OF THE ART

In rolling stands, in particular in those requiring large openings between the working rolls for rolling large product thicknesses, high reaction forces are unloaded onto the structure of the rolling stands, caused by the high rolling forces which are to be applied to the material being rolled. It is common art that bending devices for the rolls are also provided in such stands to compensate for the normal deformation of the rolls themselves, which bend under the load during the rolling operation and cause a lenticular shape to be taken by the rolling gap. If corrective or compensation measures are not implemented, such a deformation of the working rolls causes poor rolling close to the side edges of the material to be rolled, which would deform more in such areas, and the cross section thereof would take a convex, lenticular shape. Moreover, as the cooling of the rolling product is greater in the area of the side edges, the surface of the rolls faces a greater resistance precisely in such an area, resulting in greater wear of the rolls and tendency of the working rolls to wear more in such areas, thus negatively affecting the quality of the rolled product.

In order to minimize such a wear and the causes leading to the rise of grooves or of other surface defects and hence to extend the life of the rolling rolls, related bending and shifting devices are provided of the rolls in the rolling stands. These devices apply a load to the chocks of the working rolls so that the chocks of the lower working roll are neared to the respective chocks of the upper working rolls, thus taking advantage of the reaction to the deformation which the working rolls receive from the back up rolls. Thereby, the working rolls tend to take a shape such as to oppose the natural deformation thereof under the rolling load, therefore limiting or cancelling the lenticular shape of the rolled product exiting the stand.

Various kinds of bending devices for rolling rolls are disclosed in patent documents U.S. Pat. Nos. 4,770,021, 5,752,404, 6,112,569. In essence, these are bending devices implemented on rolling stands suitable for rolling thin material which however have certain limitations if a large rolling gap is required to be ensured between the rolls when rolling larger thicknesses and applying the reciprocal shifting of the working rolls is required. Shifting devices are provided in certain types of rolling stands for moving, during the rolling operation, the rolling rolls in a direction transversal to the rolling axis, so that the surface section of the rolls which works in contact with the areas of the side edges of the rolling material is not always the same, rather changes. This contrivance allows the wear to be reduced and the working life of the rolls to be extended.

WO2005/011885 discloses a rolling stand provided with a bending and shifting system under load. The upper working roll is provided with two pressure pistons on each side of the axis surrounded by an intermediate pressure-transmitting element, which can slide vertically and resist tilting against axial shifting forces. An axial shifting device is provided on either side of the center of the upper work roll. These devices are rigidly mounted with one of their axial ends on the rolling stand. The work roll chock has two arms which extend symmetrically from the axis of the work roll. In the locked position, the ends of the arms are held in the axial shifting device in a receiving slot, which extends vertically and offers the possibility that the work roll chock and thus the work roll can be vertically positioned and secured at the height in the rolling stand that corresponds to the required roll gap. The receiving slot is bounded on one side by a linear guide, which has the work roll locking mechanism, and it is bounded on the other side by a lock. Such a vertical positioning system of the work roll has however the disadvantage that it is complicated and not adaptative enough to the work conditions and it can cause the danger that during rolling the axial force acting on the work roll may not remain coaxial and could induce bending moments on the axial shifting device. Also, the presence of the intermediate-transmitting element, which can slide vertically introduces another element to be maintained because of wear; also due to the wear the system can vertically slide but in the meantime could move in horizontal direction jeopardizing the precision of the gap between rolls.

Therefore, the need is felt to provide a rolling stand having a bending device combined with a shifting device for the rolling rolls, which allows to overcome the aforesaid drawbacks.

SUMMARY OF THE INVENTION

The main object of the present invention is to provide a rolling stand with a bending device for rolling rolls which also has shifting devices, which has an improved running when activated during an operation, particularly when the gap between the rolling rolls is large in value.

The object of the invention is thus achieved by a rolling stand having bending and shifting devices for rolling rolls, which defines a rolling axis comprising, in accordance with claim 1, two housings each arranged at a respective axial end of the rolling rolls, two or more upper rolling rolls, one roll of which is the upper working roll with its own longitudinal axis, and two or more lower rolling rolls, one roll of which is the lower working roll with its own longitudinal axis, in which at a first of said two housings, there are provided two lower blocks, two upper blocks, an upper chock and a lower chock, a shifting device for the upper working roll connected to the upper chock to generate a first shifting movement of the upper roll in a parallel direction to the axis thereof by means of a first sliding coupling, a shifting device for the lower working roll connected to the lower chock to generate a second shifting movement of the lower roll in a parallel direction to the axis thereof by means of a second sliding coupling, at least one upper bearing inserted into the upper chock to allow the upper working roll to rotate about the longitudinal axis thereof, at least one lower bearing inserted into the lower chock to allow the lower working roll to rotate about the longitudinal axis thereof, in which the two lower blocks are integrally fixed to the first housing, in which the lower chock is coupled with the lower blocks by means of a third sliding coupling which allows a third shifting movement of the lower chock in the vertical direction to allow a bending load to be transmitted to the lower working roll by means of actuators reacting against the two fixed lower blocks, in which the two upper blocks are connected to the first housing by means of a fourth sliding coupling which allows a fourth vertical shifting movement of the upper blocks with respect to the first housing, to allow a bending load to be transmitted to the upper working roll by means of actuators reacting against the two fixed lower blocks, in which the first shifting movement of the upper roll is obtained by means of a sliding coupling between the upper chock and the two upper blocks and said first and second shifting movements may be carried out under load while the rolling operation occurs.

Due to this arrangement of the elements forming the bending device, to provide the bending in the lower working roll, the two actuators directly act with their rods on the chocks of the lower working roll, while the bending actuators of the upper working roll act not with the cylinder rods against the upper chocks, but by shifting the upper bending blocks which directly press against the tabs of the chocks of the upper working roll. In this way, also the pressure force transmission between top bending block and top work roll chock are optimized because a larger surface of contact can be designed. This ensures that the chocks arranged at both the ends of the upper working roll are always in contact and accurately guided by the bending blocks during the movement of the chocks in the vertical direction, and moreover, that the chocks remain in a firm position during the rolling since this device also ensures a good sliding surface between the upper bending blocks and the chocks of the upper working roll. Indeed, all the forces which are generated during the rolling operations and having directions parallel to the axis of the rolls are unloaded onto the fixed guides arranged between blocks and housings, and do not load the rods of the upper actuators, generally of the hydraulic type, in a direction transversal to the axis.

The solution of the invention allows a series of advantages to be achieved, among which we mention that the shifting may be performed under load without risks of damaging neither the actuating rolls for bending the rolls nor the blocks on which they act. In fact the shifting blocks of the working roll, due to the fact that they are rigidly fixed to the bending blocks which in turn are joined to the housing in a sliding manner in the vertical direction and not directly rigidly fixed to the housing, allow for a vertical displacement sufficient to compensate the necessary vertical displacement of the working roll, thus ensuring a parallelism of the axial forces applied by the shifting blocks to the working roll axis for every gap width. Undesired bending forces are thus avoided which could overstress the shifting system and could rapidly jeopardize the behaviour of any devices, i.e. bearings, but not only. Also, the absence of these undesidered bending forces, allows a better control of the complete rolling stand by the automatic control means.

Moreover, the solution of the invention may be applied to rolling stands equipped with rolling roll shifting devices, or in the absence of such shifting devices, and also in those stands where the rolling gap is very large.

During the application of the bending force to the rolling rolls, the chocks of the upper working roll are properly guided without creating an abnormal movement in a direction parallel to the rolling direction, with consequential decrease of the hysteresis of the rolling stand.

Another advantage of the solution of the invention is that it may be used in rolling stands which include shifting blocks for the upper and lower working rolls, which may be operated when rolling products having large thickness and which therefore require a large rolling gap between the rolls.

Moreover in this configuration, the upper and lower bending blocks remain close to the vertical axis of the housing of the rolling stand, thus avoiding the large tensions in the tabs of the chocks generated in the bending moment when the bending load is applied to the rolling rolls.

BRIEF DESCRIPTION OF THE DRAWINGS

Further features and advantages of the invention will be more apparent in the light of the detailed description of preferred, but not exclusive, embodiments of a rolling stand having a bending and shifting device for rolling rolls, shown by way of non-limiting example, with the aid of the accompanying drawings, in which.

DETAILED DESCRIPTION OF A PREFERRED EMBODIMENT OF THE INVENTION

Figure 1:
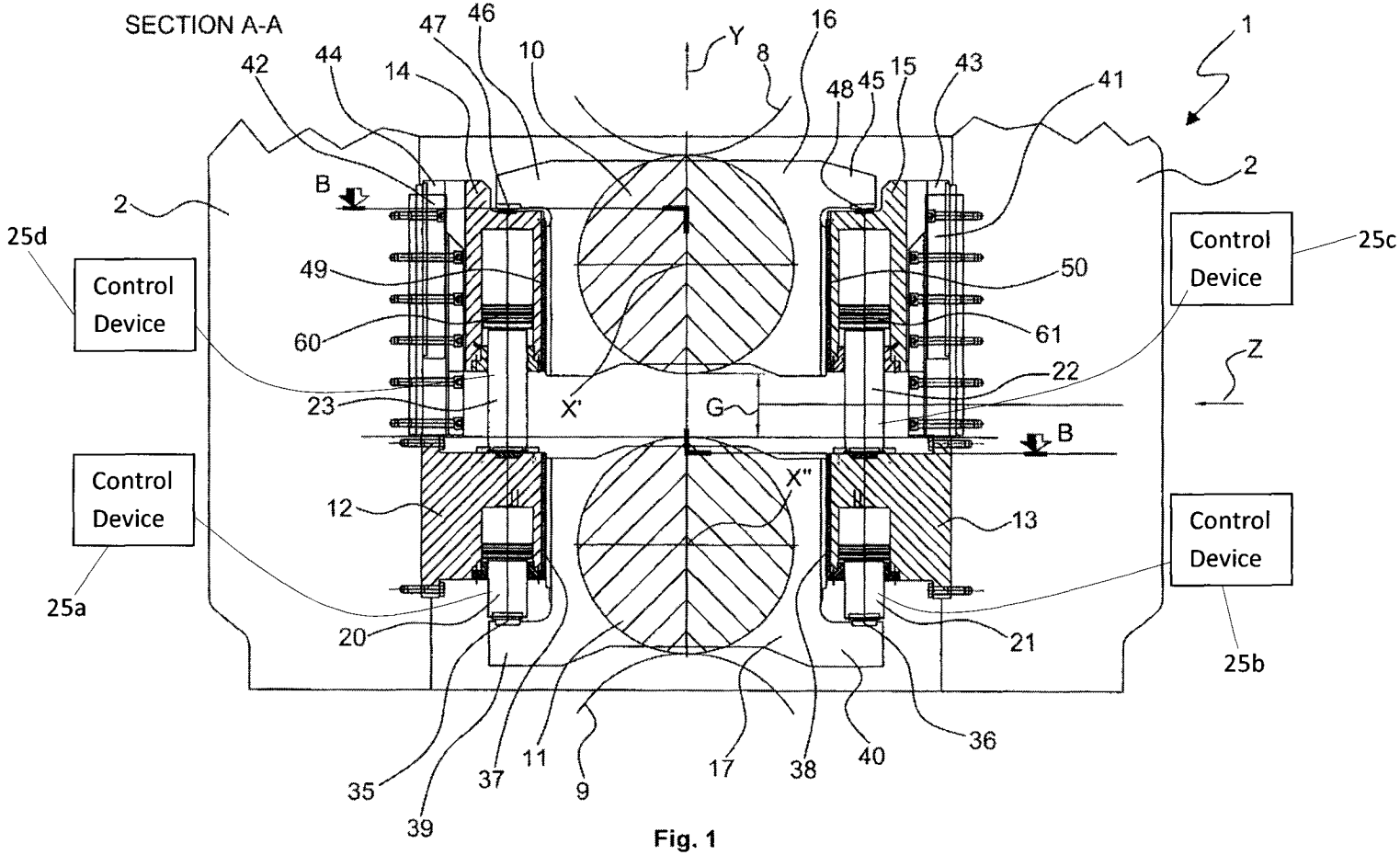
FIG. 1 depicts a section along axis A-A of the rolling stand of the invention.

With particular reference to the figures, part of a rolling stand 1 is depicted from the direction perpendicular to the rolling axis, denoted by Z.

Commonly, bending devices are always provided both on the operator side and on the control side, while shifting devices may be arranged either on the operator side or on the control side, but they are not normally arranged on both sides in the rolling systems where they are provided.

In this preferred variant of the invention, the operator side of rolling stand 1 is shown, but the structure of the bending and shifting devices is substantially the same even if it is located on the motor side of stand 1.

The motorized rolls in hot rolling systems usually are the working rolls, however in the case of cold stands or process lines, the back up ones may be motorized. In the embodiment illustrated and described herein, motors activate the working rolls 10 and 11. Rolling stand 1 may be of the fourth type with the two upper 10 and lower 11 working rolls, while the two back up rolls 8, 9, which have a larger diameter than the working rolls 10, 11, are partially drawn. Depending on the type of rolling stand considered, the back up rolls may be more than two both below and above the rolling product. The upper working roll 10 defines its longitudinal axis X', while the lower working roll 11 defines its longitudinal axis X", which is parallel to axis X'.

Rolling stand 1 defines the rolling axis Z of the rolling product (not shown in the figures) and a vertical direction Y which is orthogonal to axis Z and the roll axes X' and X". The rolling product may be either a tape or a product of larger thickness such as a slab, for example. Stand 1 includes two housings, each housing being arranged at a respective axial end of the rolling rolls and only housing 2 on the operator side is shown in the figures, while the housing on the motor side is not shown, as its structure is similar to that of the former.

Stand 1 includes both a bending device for the rolling rolls 10, 11 and a shifting device for the rolls themselves, described in greater detail below.

The two lower bending blocks 12, 13 are integrally fixed to housing 2, e.g. by means of screws or nuts or another suitable fasteners. The two axial ends of the lower rolling roll 11 are each carried by two bearings 19, 19' inserted into the two lower chocks, chock 17 of which is only shown in the figures. Bearings 19, 19' allow working roll 11 to rotate about its longitudinal axis to perform the rolling operation. Bearings 19, 19' may be equal to (in this case, the axial bearing is missing) or more than 1.

One or more hydraulic actuator rolls 20 are incorporated into the lower bending block 12 and one or more hydraulic actuator rolls 21 are incorporated into the lower bending block 13. Hydraulic actuators 20 and 21 transmit the load to two tabs 39 and 40 of the lower chock 17, respectively, thus unloading the reaction loads onto the other side on the lower bending blocks 12 and 13. Chock 17 is coupled with the lower blocks 12, 13 by means of a sliding coupling at least comprising the two surfaces 37 and 38. This coupling allows the lower chock 17 to perform a shifting movement in the vertical direction and chock 17 to be kept centered in relation to the direction of the longitudinal axis Z without obstructing it following the rolling efforts. By generating loads by means of the actuators 20, 21 which unload the reactions onto the two lower blocks 12,13, a bending load is applied to the lower working roll 10, which deviates roll 10 by a small value considering the rigidities involved, thus compensating for the bending induced by the load acting on roll 10 when rolling. As noted above, such a load is also defined as a positive bending load.

Obtained or fixed on housing 2 are two guide tracks 41, 42 which along with two complementarily shaped guides 43 and 44 form a sliding coupling which allows the two upper bending blocks 14, 15 to make a vertical shifting movement with respect to housing 2. In the embodiment shown in the figures, guides 43 and 44 are of the T-shaped type and, with particular reference to FIG. 4, the two guide elements 44' and 44" obtained in a single piece form, along with track 42, the sliding coupling having one single level of freedom corresponding to the vertical shifting in direction Y, while it longitudinally holds chock 16 according to direction Z, thus allowing the sliding thereof in a direction parallel to axis X'. In this vertical upward or downward shifting movement in a direction of Y, which is a widening of rolling gap G or a narrowing of gap G, blocks 14 and 15 are loaded by the forces generated by the hydraulic actuator rolls 23 and 22, which unload the reactions against the two lower blocks 12, 13 integrally fixed to housing 2. Blocks 14 and 15 transmit a bending load to tabs 45 and 46 of chock 16, and obviously to the symmetrical one arranged at the other axial end of the upper working roll 10. The load applied by the hydraulic actuators 22 and 23 deforms the upper roll 10 just enough, thus compensating for the deflection induced by the load acting on roll 10 when rolling.

The two bearings 18, 18' are inserted into the upper chock 16 and allow the upper working roll 10 to rotate about its longitudinal axis X', which rotation is required to roll the product. The arrangement and operation of bearings 18 and 18' in relation to the lower working roll 11 is similar.

The same constructional elements included in the above-described bending and shifting devices are also present in the part of the bending and shifting devices arranged at the second axial end of the rolling rolls 10, 11, on the opposite side to rolling stand 1 (not shown in the figures). The bending and shifting movements of the rolls are also complementarily performed on the side of stand 1 which cannot be seen, whereby they are not shown in the figures and are not further described. Four shifting blocks 30, 31 are provided on the operator side of rolling axis Z or on the motor side with respect to rolling axis Z.

Of these four blocks, two upper shifting blocks—of which only block 30 is shown in the figures—are respectively fixed to the two bending blocks 14, 15 of the upper chock 16 of the upper working roll 10 so as to be able to exert on the upper chock 16 a force parallel to upper roll axis X'.

The other two shifting blocks—of which only block 30 is shown in the figures—are fixed to housing 2 or to another structure integral with rolling stand 1, and are able to exert on the lower chock 17 of the lower working roll 11 a force parallel to lower roll axis X".

The shifting block 30 is made integral with the upper chock 16 by means of the plates 53', 53" which are fixed to an extremity of the chock 16 and by means of rigid structural elements 51, 55 is rigidly fixed to the upper bending block 14. As the upper bending block 14 is slidingly connected to housing 2, also the shifting block 30 can move along a vertical path, sliding with block 14. The shifting block 30 thus follows exactly the translation of the bending block 14 during the closing or opening operation of the two working rolls 10, 11 necessary to modify the amplitude of the gap G.

In this manner no undesired bending forces are introduced into the structure comprised of the chock 16 and plates 53', 53", 51, 55 and the shifting forces acting on the working roll 10 remain always parallel to the axis X', unlike other solutions of the state of the art.

In the apparatus according to the invention the axial force $F_A$ exerted by the working roll 10 on the chock 16 will produce a reaction on the housing 2, not directly on the body of the housing, but over the block 14 and the guide track 42 with a better distribution of loads on the structure.

When pushing or pulling chock 16, the shifting block 30 allows a shifting movement of the upper roll 10 to be generated in a direction parallel to its axis X' due to the presence of the sliding coupling consisting of the sliding surfaces 47 and 49 on the side of block 14 and of the sliding surfaces 48 and 50 on the side of block 15. Since the shifting performed by working roll 10 in the direction of axis X' occurs due to the presence of the coupling consisting of the surfaces 47, 49 and 48, 50, respectively, arranged at the two sides of chock 16, the two hydraulic actuator 22 and 23 are not subjected to loads which cause the piston rod to bend, which is thus compression loaded only.

As the two hydraulic actuators 22 and 23 are configured in such a manner that the piston rods are positioned below the pistons 60, 61, so that the blocks 14 and 15 constitute the housing for the pistons 60, 61 the sliding surfaces 47, 49 and 48, 50 are designed with a larger area thus improving the slidability of the chock 16. Thanks to this configuration the piston rods of actuators 22 and 23 may also be made longer, which allows a larger rolling gap to be obtained.

Shifting block 31 of the lower working roll 11 is integrally fixed to the lower chock 17 and can generate a shifting movement of the lower working roll 11 in a direction parallel to its axis X" by means of the sliding coupling which comprises the contact surfaces 35 and 37 arranged on the side of block 12 and the contact surfaces 36 and 38 arranged on the side of block 13. The piston rods of actuators 20 and 21 may be made shorter since the lower chock, and therefore the working roll 11, should provide a lesser travel as the height of rolling gap G is mainly determined by the travel of the upper working roll. The bending force which is to be applied by the upper actuators 22 and 23 when the rolling gap is large implies a greater extension of the rod of the upper actuators 22 and 23 with respect to the lower ones 20, 21. The rolling stand also has control devices 25*a-d* (see FIG. 1) of the height of the rolling gap G, which set the gap value at the required value.

The shifting movements of the rolls controlled by the shifting blocks 31 may be performed under load during the rolling operation, because even if the rods of the upper actuators 22 and 23 are longer, they are not subjected to transversal loads to their axis and do not risk bending, while the rods of the lower actuators 20 and 21, which instead slide along surfaces 35 and 36 with respect to tabs 39 and 40, are squat and may oppose the side loads generated during the sliding movement caused by shifting, thus not risking bending. Alternatively to the configuration described, the hydraulic actuators 23 and 22 may be arranged upside down by 180°, hence acting upwards on the tabs 46 and 45 of chock 16 (which solution has been already commonly used). In this case, for large travels of the actuators 22 and 23, therefore for large values of the rolling gap G, the diameter of the rods should be sized larger to prevent maximum load problems from arising.

In all the above-described sliding couplings which allow sliding movements between the surfaces forming the couplings themselves even in the presence of large loads due to the high forces involved during the rolling operation, a coating is advantageously provided on the surfaces, with metals having a low friction coefficient, e.g. by arranging brasses, which also allows a quick replacement when the sliding surfaces are worn by the sliding movements which occur under load.

Figure 2:
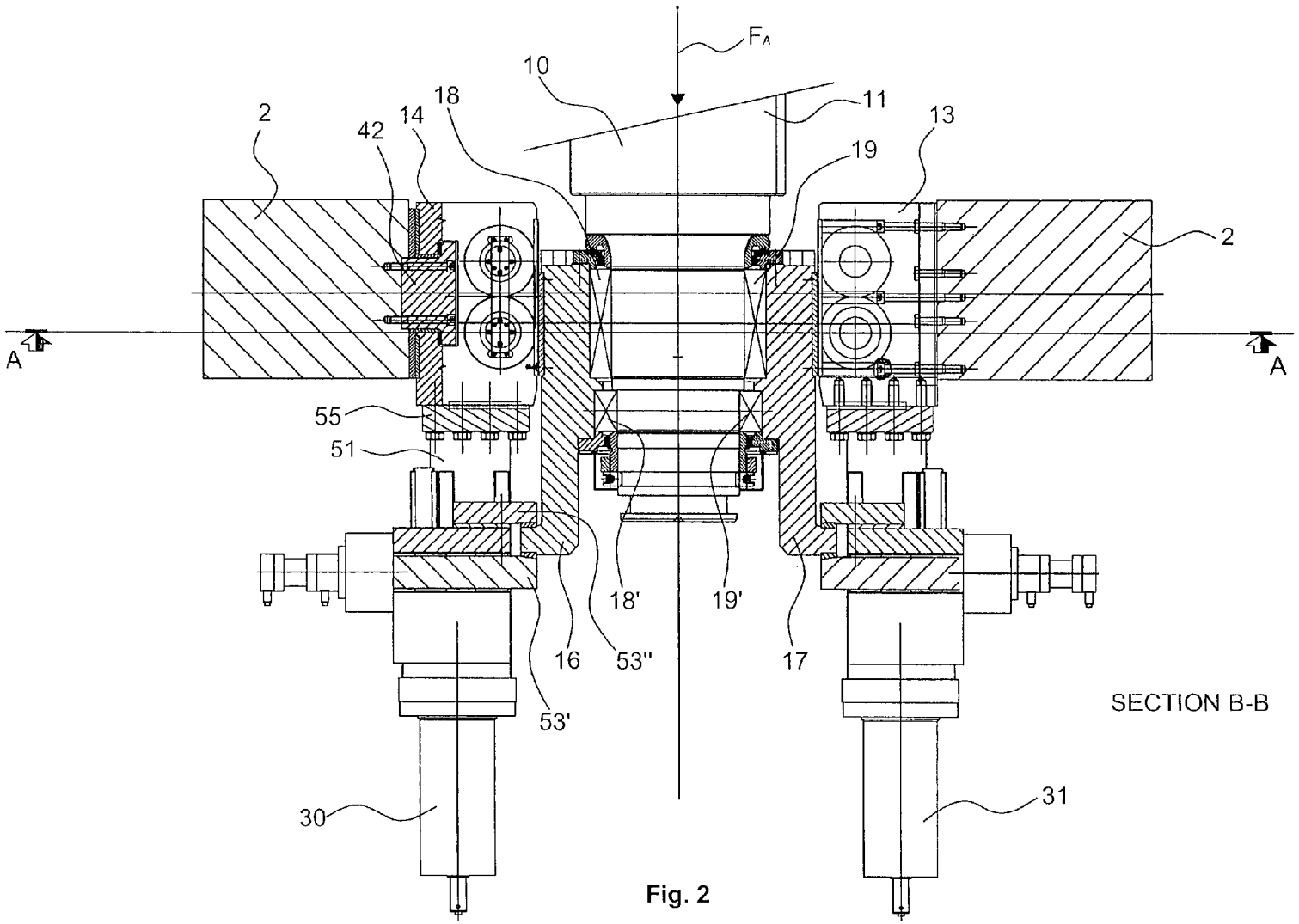
FIG. 2 depicts a section along axis B-B of the rolling stand of the invention.
Figure 4:
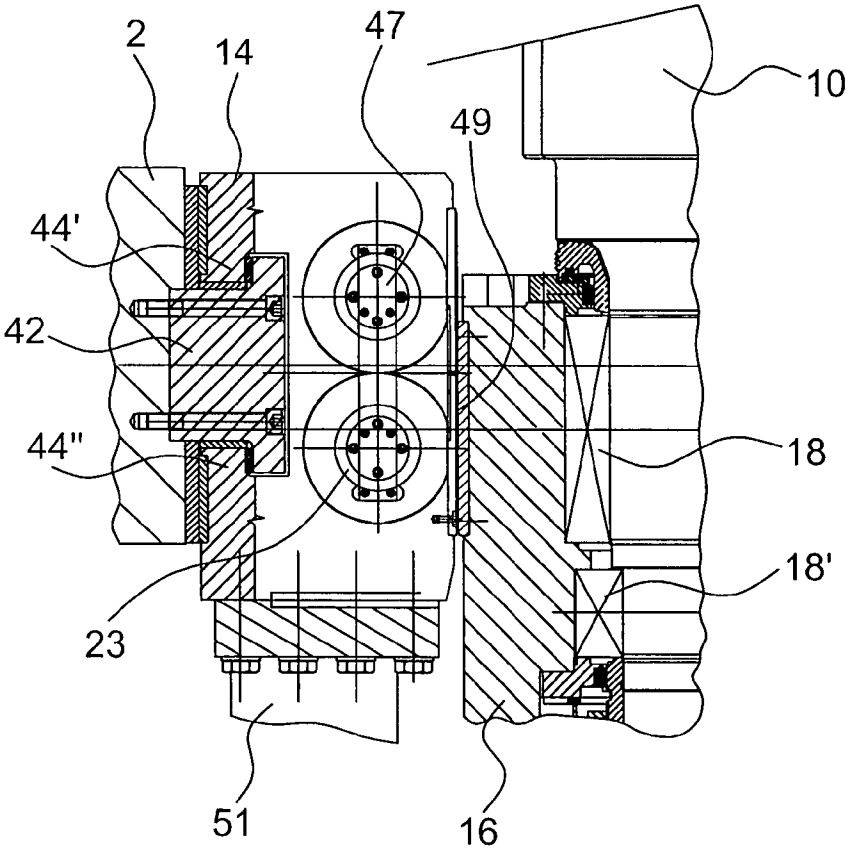
FIG. 4 depicts an enlarged detail of FIG. 2.
Figure 3:
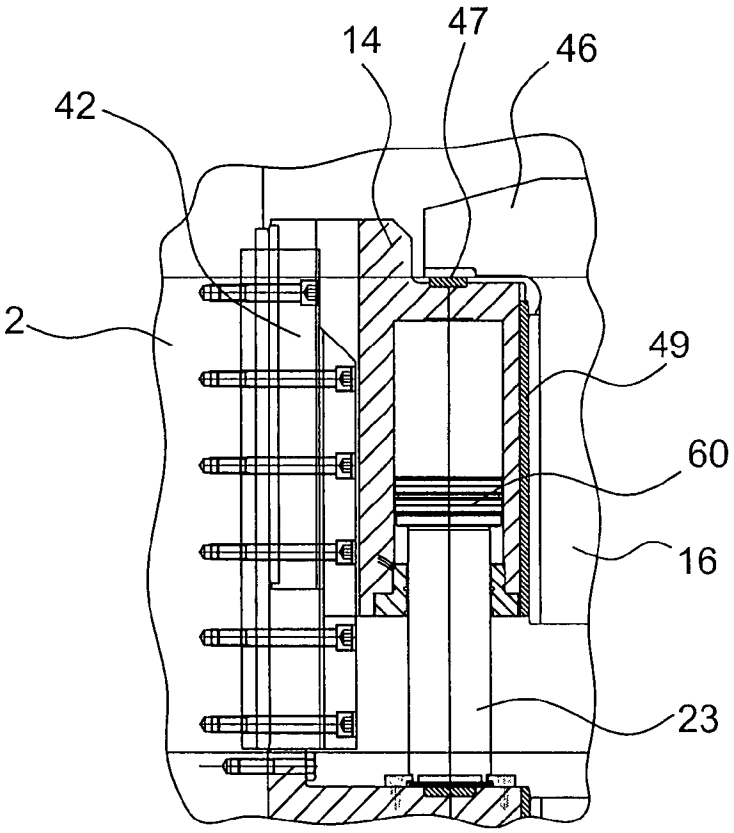
FIG. 3 depicts an enlarged detail of FIG. 1.

The hydraulic actuator rolls 20, 21, 22, 23 arranged at each chock 16 and 17 of the upper and lower rolls are advantageously two, i.e. they are advantageously arranged in pair on each side of each chock as particularly shown in figures 2 and 4. Such a paired arrangement of the actuators allows the bending load applied to the chocks of the rolls to be redistributed along the axial length of each bearing 18, 19. Indeed, when a single actuator is placed on each side of the bearing, the force of compensating for the bending generated by the actuator overloads a limited axial area of the bearing, thus generating an increased wear of the bearing in such an area. Arranging two actuators results in an almost uniform distribution of the load acting on the bearing over its length, and in practice, the resultant of the bending load always acts at the axis of the bearing, thus differently loading the two actuators which form the pair.

We claim:

1. A rolling stand provided with a bending and shifting device for rolling rolls, defining a rolling axis, comprising two housings, each arranged at a respective axial end of the rolling rolls, two or more of said rolling rolls being upper rolling rolls, one roll of which is an upper working roll with a longitudinal axis thereof, and two or more of said rolling rolls being lower rolling rolls, one roll of which is a lower working roll with a longitudinal axis thereof, wherein at a first of said two housings there are provided two lower bending blocks, two upper bending blocks, an upper chock and a lower chock, a first shifting device for the upper working roll connected to the upper chock to produce a first axial shifting movement of the upper working roll in a direction parallel to a first roll axis utilizing a first sliding coupling, a second shifting device for the lower working roll fixed to the first housing and connected to the lower chock to produce a second axial shifting movement of the lower working roll in a direction parallel to a second roll axis utilizing a second sliding coupling, at least one upper bearing inserted into the upper chock to allow the upper working roll to rotate about the longitudinal axis thereof, at least one lower bearing inserted into the lower chock to allow the lower working roll to rotate about the longitudinal axis thereof, wherein the two lower bending blocks are integrally fixed to the first housing, wherein the lower chock is coupled to the lower beading blocks utilizing a third sliding coupling which allows a third shifting movement of the lower chock in the vertical direction to allow a bending load to be transmitted on the lower working roll utilizing first actuators incorporated in the lower bending blocks and reacting against the two lower bending blocks, wherein the two upper bending blocks are slidingly connected to the first housing utilizing a fourth sliding coupling having a "T" shape which allows a fourth vertical shifting movement of the upper bending blocks with respect to the first housing, to allow the bending load to be transmitted on the upper working roll utilizing second actuators incorporated in the upper bending blocks and reacting against the two lower bending blocks, said lower bending blocks being rigidly fixed to the first housing, wherein said first shifting device for the upper working roll comprises two upper shifting blocks respectively fixed to the two upper bending blocks whereby also the upper shifting blocks can move along a vertical path, sliding with the upper bending blocks, wherein the first axial shifting movement of the upper working roll is obtained utilizing said first sliding coupling between the upper chock and the two upper bending blocks and said first and second axial shifting movements can be carried out under load while a rolling operation occurs wherein the upper bending blocks and the lower bending blocks are connected to one another only through the housing and the second actuators.

2. A rolling stand according to claim 1, wherein the two upper shifting blocks are fixed to the chock of the upper working roll so as to be able to exert on the upper chock a force applied always to said first roll axis to produce said first axial shifting movement avoiding any force moment.

3. A rolling stand according to claim 1, wherein there are provided four second actuators at the end of the upper working roll, arranged in two pairs, one pair on each side of the axis of the upper working roll, and there are provided four or more first actuators at the end of the lower working roll arranged in two pairs, one pair on each side of the lower working roll.

4. A rolling stand according to claim 1, wherein said first, second, third and fourth sliding couplings comprise contact surfaces made of low surface friction metal.

5. A rolling stand according to claim 4, wherein the actuators each comprise a piston and a rod acting on the piston, and are arranged with the rod in a lower position with respect to the piston.

6. A rolling stand according to claim 1, wherein rolling gap control devices are provided.

7. A rolling stand according to claim 2, wherein rolling gap control devices are provided.

8. A rolling stand according to claim 3, wherein rolling gap control devices are provided.

9. A rolling stand according to claim 4, wherein rolling gap control devices are provided.

10. A rolling stand according to claim 5, wherein rolling gap control devices are provided.

* * * * *